United States Patent [19]

Kido et al.

[11] Patent Number: 4,938,197

[45] Date of Patent: Jul. 3, 1990

[54] FUEL SUPPLY CONTROL SYSTEM FOR ENGINE

[75] Inventors: Yoshinobu Kido; Toshihiro Handa; Tetsushi Hosokai; Naoya Takada, all of Hiroshima, Japan

[73] Assignee: Mazda Motor Corporation, Hiroshima, Japan

[21] Appl. No.: 152,936

[22] Filed: Feb. 5, 1988

[30] Foreign Application Priority Data

Feb. 5, 1987 [JP] Japan ..... 62-25429

[51] Int. Cl.[5] ..... F02P 5/04; F02M 7/00

[52] U.S. Cl. ..... 123/492; 123/417; 123/438; 123/478

[58] Field of Search ..... 123/492, 438, 478, 489, 123/493, 417

[56] References Cited

U.S. PATENT DOCUMENTS

| | | | |
|---|---|---|---|
| 4,313,412 | 2/1982 | Hosaka et al. | 123/480 |
| 4,376,428 | 3/1983 | Hata et al. | 123/417 |
| 4,488,529 | 12/1984 | Nishida et al. | 123/438 |
| 4,561,404 | 12/1985 | Kanno et al. | 123/492 |
| 4,582,037 | 4/1986 | Otsuka et al. | 123/492 |
| 4,665,878 | 5/1987 | Taceuchi et al. | 123/492 |
| 4,683,860 | 8/1987 | Shimamura et al. | 123/492 |
| 4,745,901 | 5/1988 | Reifenberger et al. | 123/492 |

*Primary Examiner*—Raymond A. Nelli

*Attorney, Agent, or Firm*—Sixbey, Friedman, Leedom & Ferguson

[57] ABSTRACT

A fuel supply control system for an engine associated with a transmission for transmitting the engine output power to driving wheels of a vehicle increases the amount of fuel to be supplied to the engine when the engine is in a particular operating condition in which relatively large engine output power is required. The fuel supply control system receives a signal from a switch which is switched over according to whether the engine is associated with a manual transmission or an automatic transmission, and controls the amount by which the fuel to be supplied to the engine is increased when the engine is in the particular operating condition so that the amount is smaller when the engine is associated with an automatic transmission than when the engine is associated with a manual transmission.

12 Claims, 7 Drawing Sheets

FUEL SUPPLY CONTROL SYSTEM FOR ENGINE

BACKGROUND OF THE INVENTION

Field of the Invention

This invention relates to a fuel supply control system for an engine.

Description of the Prior Art

It has been known to increase the fuel supply to an engine during operation under heavy load in order to increase engine output power, as disclosed in Japanese Unexamined Utility Model Publication No. 54(1979)-124822 and U.S. Pat. No. 4,488,529, for instance. However, in such engines, the fuel increasing characteristics according to which the fuel supply is increased during heavy load operation have conventionally been determined irrespective of whether the vehicle is provided with an automatic transmission or a manual transmission, and accordingly, fuel economy is apt to be deteriorated as power transmission efficiency is lowered in the case of a vehicle having an automatic transmission.

Further, the fuel increasing characteristics according to which the fuel supply to the engine is increased when the fuel requirement is increased such as during heavy load operation of the engine are set so that the air-fuel ratio can be a value that ensures sufficient engine output power even if the vehicle is required to accelerate under such conditions.

That is, when the engine output power requirement is increased when the engine is operated under a heavy load, a fuel increase correction is effected to increase the fuel supply to make the air-fuel ratio richer than that in the normal operation of the engine. When the increasing rate of the fuel supply in the operating range is reduced in the case where the vehicle has a manual transmission, increase in engine output power becomes insufficient and increase in engine speed lags, thereby deteriorating acceleration performance and giving rise to fluctuation in engine output power, since during acceleration in the case of the manual transmission the load acts directly on the engine by way of the transmission. Further, when combustion in the combustion chambers is unstable such as during warm-up of the engine, small fluctuations in load can change engine output power by a large amount, and accordingly, also in such a case, a fuel increase correction is effected to enrich the air-fuel ratio, thereby ensuring sufficient engine output power. Also in this case, if the fuel supply increasing rate is relatively small, fluctuation in the engine output power due to fluctuation in the combustion in combustion chambers is transmitted directly to the driving wheels, deteriorating the operating performance in the case of a manual transmission.

On the other hand, in the case of an automatic transmission having a torque convertor, momentary load fluctuations cannot be transmitted, and engine output power is not transmitted to the driving wheels until the engine output power and engine speed are increased in response to an accelerating operation. Further, in the case of an automatic transmission, load fluctuation has a lesser effect on the engine during warm-up and stable operating performance can be obtained.

SUMMARY OF THE INVENTION

In view of the foregoing observations and description, the primary object of the present invention is to provide a fuel supply control system for an engine in which fuel economy can be improved without adversely affecting the engine output power performance when the fuel supply control system is associated with an automatic transmission, while on the other hand, when the fuel supply control system is associated with a manual transmission, high engine output power can be obtained by way of the transmission.

In accordance with the present invention, there is provided a fuel supply control system for an engine associated with a transmission for transmitting the engine output power to driving wheels of a vehicle, comprising a fuel supply means for supplying an amount of fuel according to engine operating condition, a fuel increasing means which increases the amount of fuel to be supplied to the engine when the engine is in a particular operating condition in which a relatively large engine output power is required, a transmission detecting means which detects whether the transmission associated with the engine is a manual transmission in which the engine output shaft and the transmission output shaft are mechanically connected or an automatic transmission in which the engine output shaft and the transmission output shaft are connected to permit slip therebetween, and a fuel increase control means which controls the fuel increasing means according to whether the engine is associated with a manual transmission or an automatic transmission so that the amount by which the fuel to be supplied to the engine is increased when the engine is in the particular operating condition is smaller when the engine is associated with an automatic transmission than when the engine is associated with a manual transmission.

For example, when an engine is operated under a heavy load, when an engine is being warmed up, when an engine is in an early stage of acceleration and when an engine is returning from the state in which the fuel supply has been cut the engine may be considered to be in the particular operating condition in which a relatively large engine output power is required.

As the automatic transmission in which the engine output shaft and the transmission output shaft are connected to permit slip therebetween, there are those having a fluid coupling.

DESCRIPTION OF THE PREFERRED EMBODIMENTS

Figure 1:
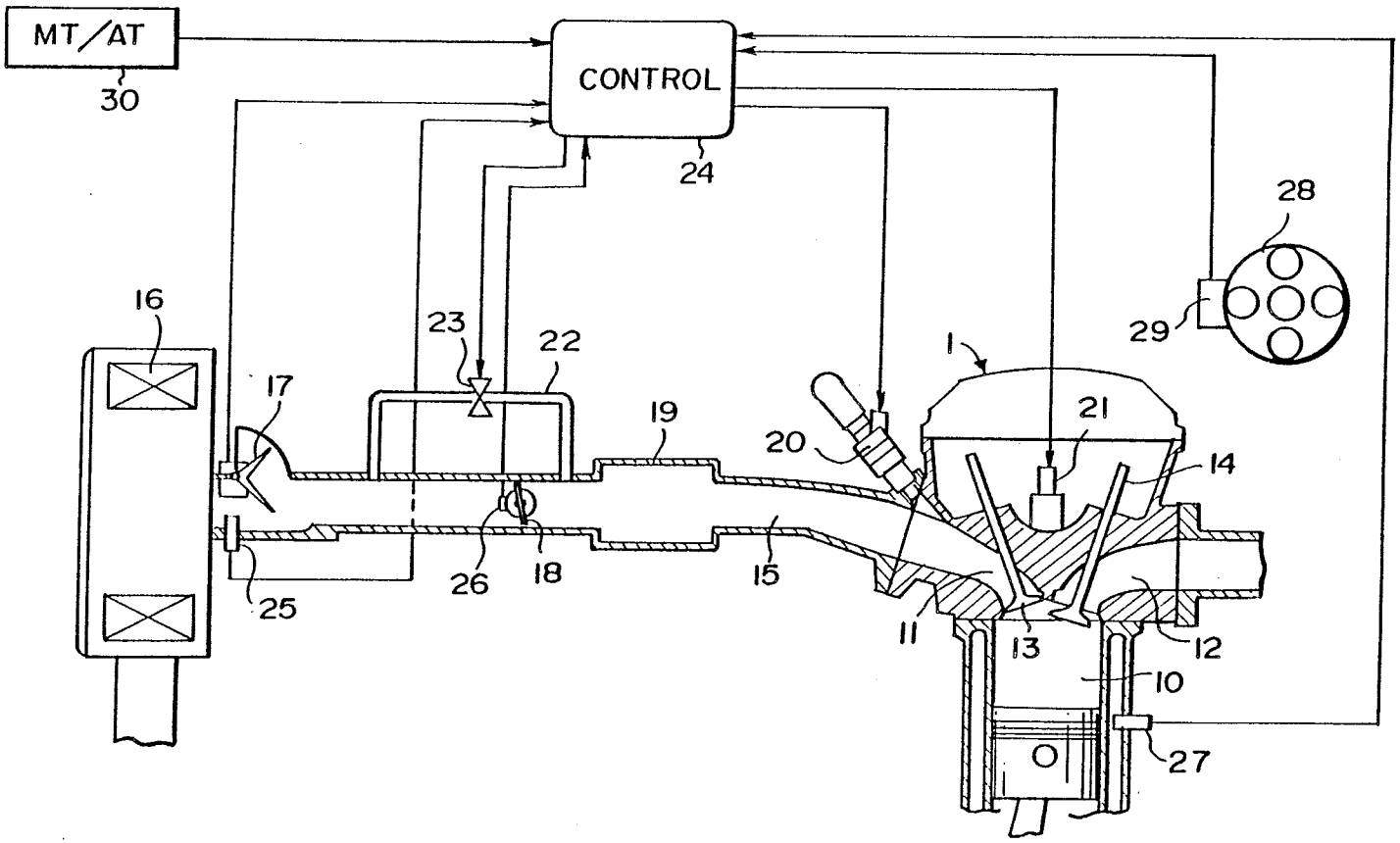
FIG. 1 is a schematic view showing an engine provided with a fuel supply control system in accordance with an embodiment of the present invention.

With reference to FIG. 1, in an engine 1 provided with a fuel supply control system in accordance with an embodiment of the present invention, an intake port 11 and an exhaust port 12 open into a combustion chamber 10. The intake port 11 and the exhaust port 12 are provided respectively with an intake valve 13 and an exhaust valve 14. The intake port 11 opens to the atmosphere by way of an intake passage 15 which is provided with an air cleaner 16, an airflow meter 17, and a throttle valve 18, in this order from the upstream side. The intake passage 15 is further provided with a surge tank 19 and the intake passage 15 is branched at a portion downstream of the surge tank 19 into a plurality of discrete intake passages leading to the respective combustion chambers 10. (Though only one combustion chamber 10 is shown in FIG. 1, the engine 1 is a multiple-cylinder engine.) A fuel injection nozzle 20 is disposed in a downstream end portion of each discrete intake passage to inject fuel toward the intake port 11.

A spark plug 21 is provided projecting into the combustion chamber 10. The intake passage 15 is further provided with a bypass passage 22 which bypasses the throttle valve 18. The bypass passage 22 is provided with a SIG valve 23 for controlling the amount of intake air flowing through the bypass passage 22.

The fuel injection amount, that is, the amount of fuel to be injected from the fuel injection valve 20, is controlled by a control signal (fuel injection pulse) output from a control unit 24. The control unit 24 effects various controls such as control of ignition timing and control of the SIG valve 23 (idling speed control) and the like in addition to the fuel supply control.

In order to detect an operating condition of the engine 1, an intake air amount signal from the airflow meter 17, an air temperature signal from an intake air temperature sensor 25 provided in the intake passage 15 in the vicinity of the airflow meter 17, a throttle opening signal from a throttle position sensor 26, a coolant temperature signal from a coolant temperature sensor 27 for detecting the temperature of the engine coolant, and a crank angle signal (an engine speed signal) from a crank angle sensor 29 provided on a distributor 28 are input into the control unit 24. Further, a transmission signal for determining whether the vehicle is provided with a manual transmission or an automatic transmission is input into the control unit 24 from a transmission distinguishing means 30.

The control unit 24 controls the fuel injection amount (the air-fuel ratio), the ignition timing, SIG and the like according to the detected operating condition of the engine 1. Basically, the control unit 24 calculates the fuel injection amount on the basis of the amount of intake air and the engine speed, and sets a fuel injection pulse corresponding to the calculated fuel injection amount, while in an engine stall zone, a starting zone, an over-revolution zone, or a deceleration zone, the control unit 24 sets the fuel injection pulse separately. When the engine is operating under a particular condition, e.g., heavy load operation or warm-up, the control unit 24 increases the fuel injection amount by an amount which is smaller when the vehicle is provided with an automatic transmission than when the vehicle with a manual transmission.

Figure 2:
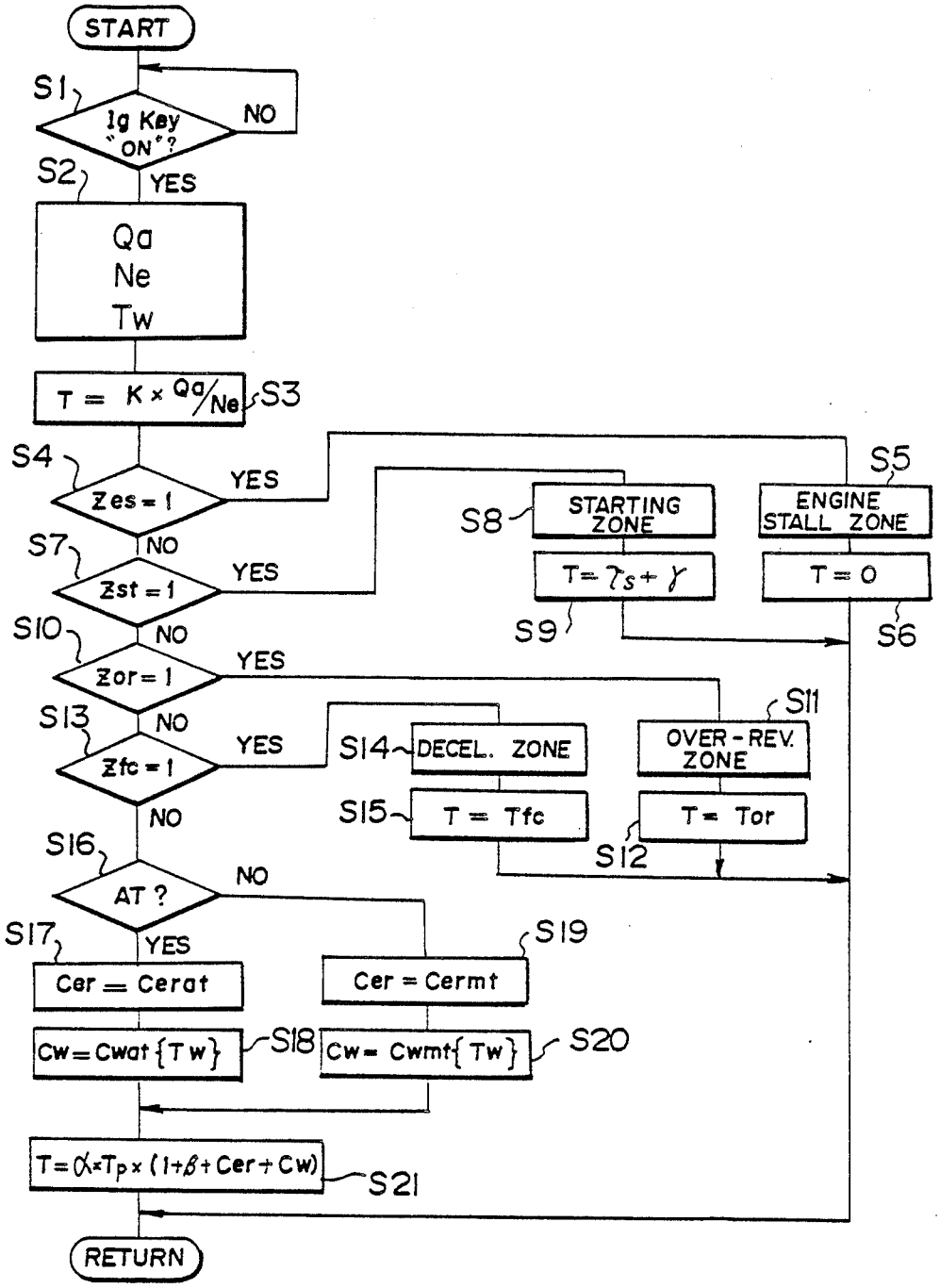
FIG. 2 is a flow chart for illustrating the operation of a control unit employed in the fuel supply control system shown in FIG. 1.

The operation of the control unit 24 will be described with reference to the flow chart shown in FIG. 2. When the ignition key is turned to the ON position, the control unit 24 reads the signals from the sensors and calculates the amount of intake air Qa, the engine speed Ne and the coolant temperature Tw. (Steps S1 and S2) A basic fuel injection pulse width Tp then is calculated on the basis of the amount of intake air Qa and the engine speed Ne ($Tp=K\times Qa/Ne$, where K represents a constant) in step S3. In step S4, it is determined whether the operating condition of the engine is in the engine stall zone by way of an engine stall zone flag Zes which is set according to the engine speed Ne. When it is determined that the operating condition is in the engine stall zone in the step S4, the control unit 24 sets the fuel injection pulse T at 0. (Steps S5 and S6) In step S7, it is determined whether the operating condition is in the starting zone by way of a starting zone flag Zst which is set according to the starter signal. When it is determined that the operating condition is in the starting zone in the step S7, the control unit sets the fuel injection pulse T at a predetermined value on the basis of a preset value $\tau s$ which is determined according to the coolant temperature and the like, and a constant $\gamma$. (Steps S8 and S9)

In step S10, it is determined whether the operating condition is in the over-revolution zone by way of an over-revolution zone flag Zor which is set according to the engine speed Ne. When it is determined that the operating condition is in the over-revolution zone in the step S10, the control unit 24 sets the fuel injection pulse T at Tor to proceed to fuel cut. (Steps S11 and S12) In step S13, it is determined whether the operating condition is in the deceleration zone by way of a deceleration zone flag Zfc which is set according to the engine speed Ne and the throttle opening. When it is determined that the operating condition is in the deceleration zone in the step S13, the control unit 24 sets the fuel injection pulse T at Tfc to proceed to fuel cut. (Steps S14 and S15)

When all the zone flags are reset, it is determined that the operating conditions are in the normal zones, and whether the vehicle is provided with an automatic transmission AT is determined in step S16. When it is determined that the vehicle is provided with an automatic transmission AT in the step S16, the heavy load increase coefficient Cer is set at a preset valve Cerat for automatic transmission in step S17, and the warm-up increase coefficient Cw is set at a preset value Cwat for automatic transmission in step S18, the preset value Cwat for being changed according to the coolant temperature Tw. On the other hand, when it is determined that the vehicle is not provided with an automatic transmission but with a manual transmission MT, the heavy load increase coefficient Cer is set at a preset value Cermt for manual transmission in step S19, and the warm-up increase coefficient Cw is set at a preset value Cwmt for manual transmission in step S20, the preset value Cwmt being changed according to the coolant temperature Tw. Then in step S21, a final fuel injection pulse T is calculated. That is, $T=\alpha\times Tp\times(1+\beta+Cer+Cw)$, wherein $\alpha$ represents a coefficient and $\beta$ represents a constant.

Figure 3:
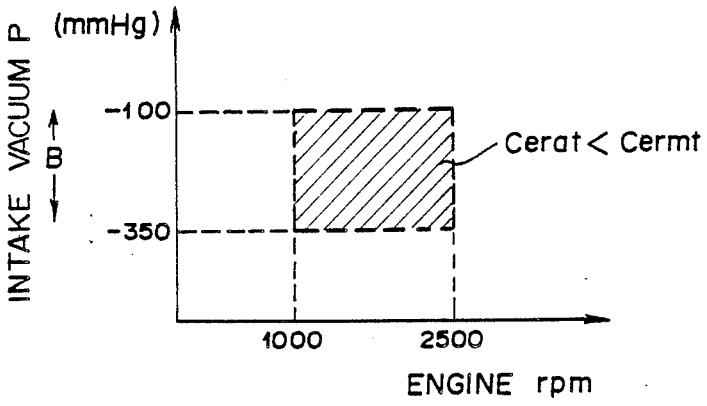
FIG. 3 is a view for illustrating the range in which a heavy load increase coefficient is set.

The heavy load increase coefficient Cer is set when the operating condition is in the heavy load operation range (the hatched portion in FIG. 3) defined by the engine speed Ne and intake vacuum pressure P, and the preset value Cermt for manual transmission is larger than the preset value Cerat for automatic transmission. The preset value Cermt for manual transmission is a coefficient which gives an air-fuel ratio A/F of 14.7 (e.g., 0), and the preset value Cerat for automatic transmission is a coefficient which gives an air-fuel ratio of 15 to 16 (e.g., −0.2).

Figure 4:
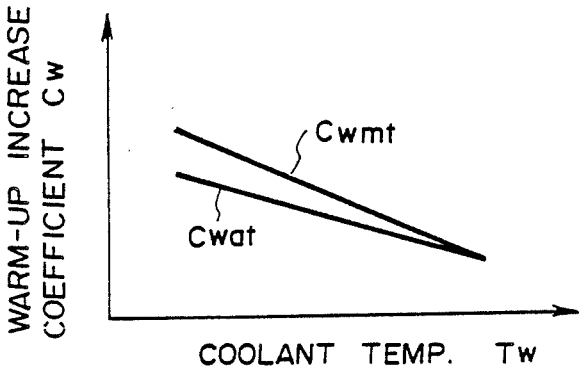
FIG. 4 is a view for illustrating the characteristics according to which a warm-up increase coefficient is set.

The warm-up increase coefficient Cw is set according to the characteristics shown in FIG. 4, and the fuel injection amount is increased by an amount that becomes larger as the coolant temperature Tw becomes lower. The preset value Cwat for automatic transmission is smaller than the preset value Cwmt for a given coolant temperature Tw.

Figure 5:
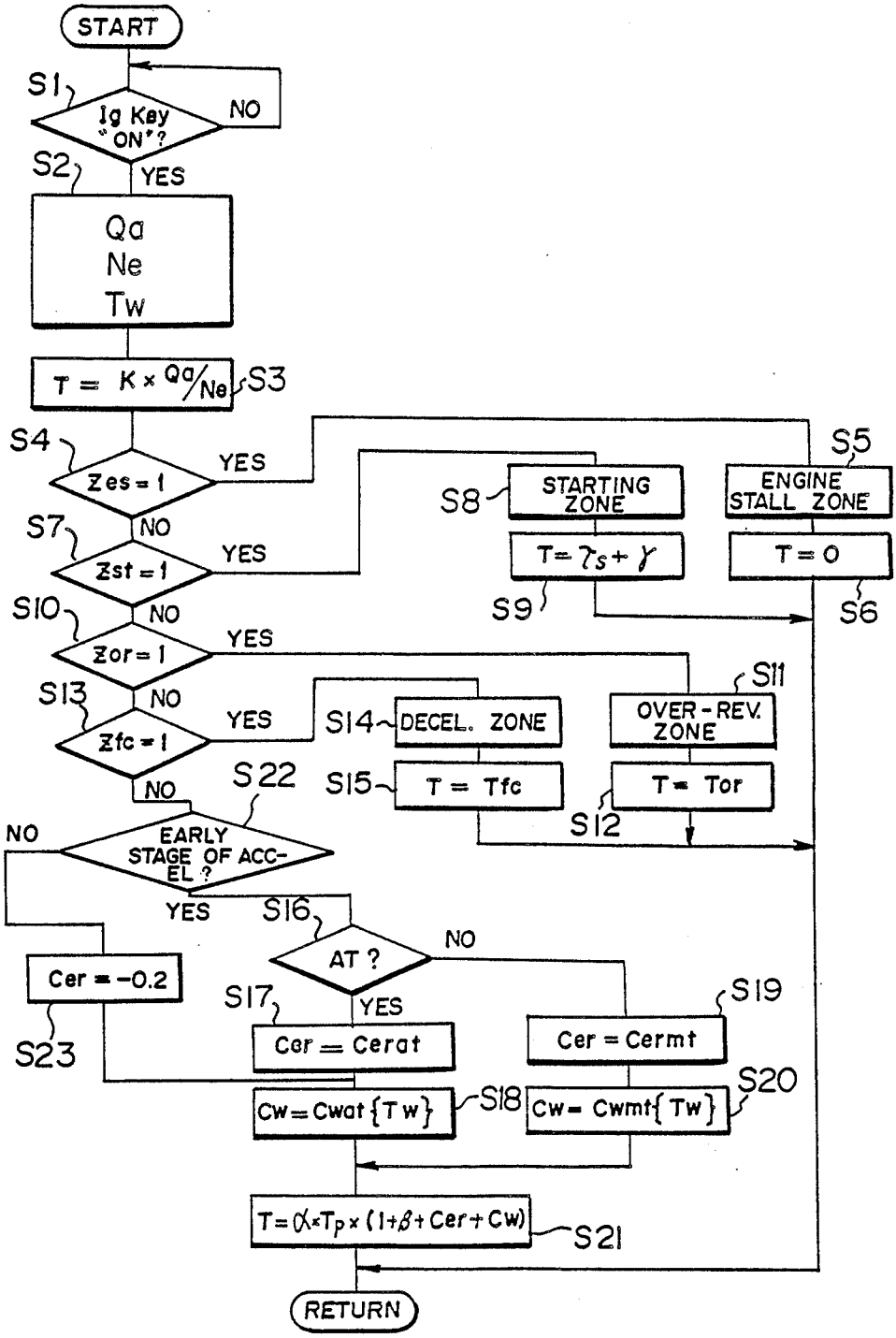
FIG. 5 is a flow chart for illustrating the operation of the control unit employed in another embodiment of the present invention.

FIG. 5 shows a flow chart for illustrating the operation of the control unit 24 in accordance with another embodiment of the present invention. The operation of the control unit 24 shown in the flow chart in FIG. 5 is substantially the same as that shown in FIG. 2, and accordingly, only the difference therebetween will be described here. In the flow chart shown in FIG. 5, when it is determined that the operating condition is not in the deceleration zone in the step S13, the control unit 24 determines whether the engine is in the early stages of acceleration in step S22. Whether the engine is in the early stages of acceleration can be determined by detecting whether a predetermined time has elapsed after the increasing rate of the engine speed reaches a preset value, whether a predetermined time has elapsed after the throttle valve is abruptly opened, or a predetermined time lapses after the increasing rate of the vehicle speed reaches a preset value. When it is determined that the engine is in the early stages of acceleration in the step S22, the control unit 24 proceeds to the step S16 to set the heavy load increase coefficient according to the kind of transmission the vehicle is provided with. Otherwise, the control unit 24 sets the heavy load increase coefficient at −0.2 irrespective of the kind of the transmission in step S23. The control unit 24 then proceeds to steps S18.

In accordance with this embodiment, sufficient acceleration can be obtained in the early stages of acceleration while when the acceleration is continued for an extended time, the increasing rate of the fuel injection amount is reduced to improve fuel economy.

Figure 6:
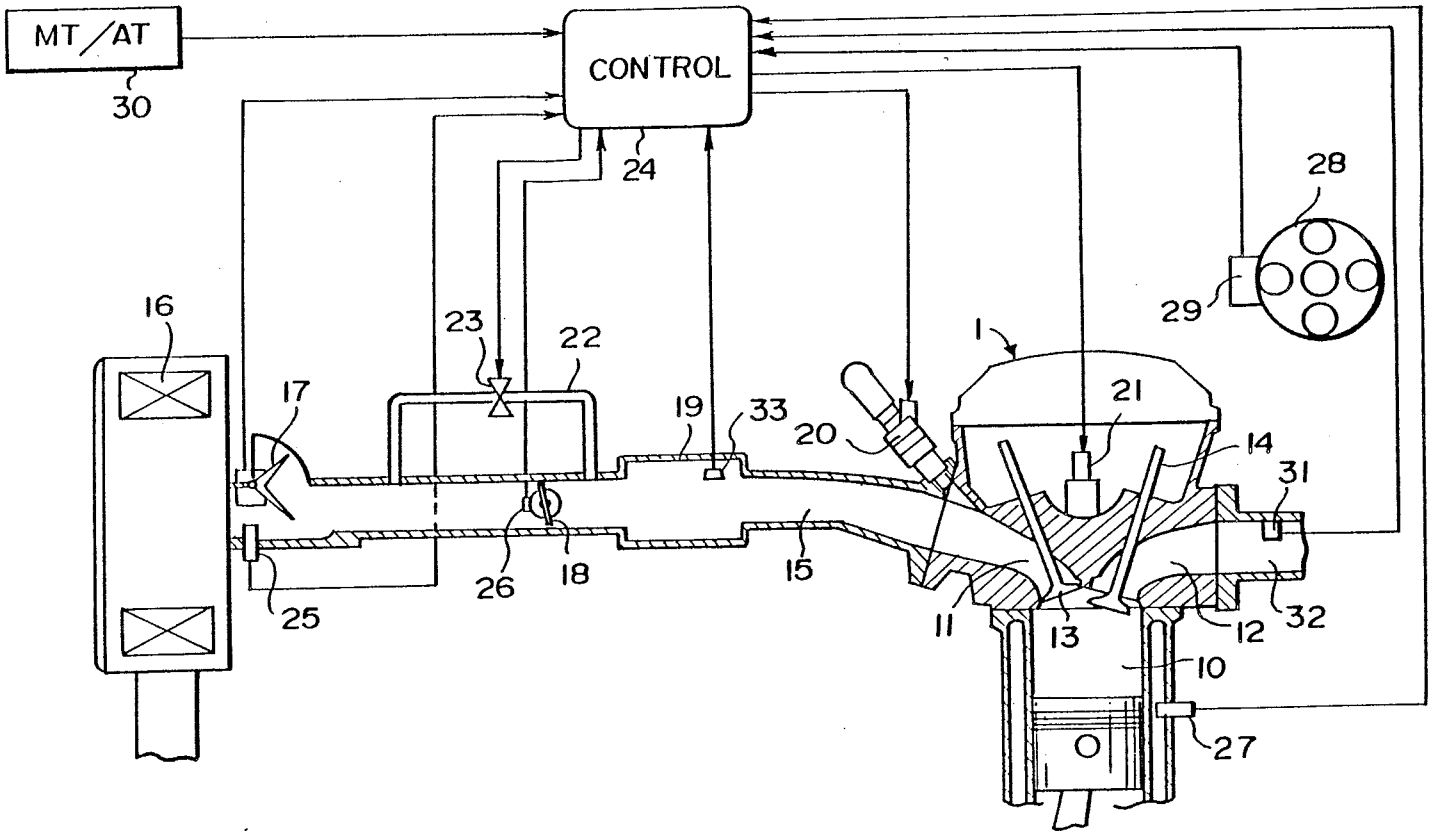
FIG. 6 is a view similar to FIG. 1 but showing an engine provided with a fuel supply control system in accordance with still another embodiment of the present invention.
Figure 7:
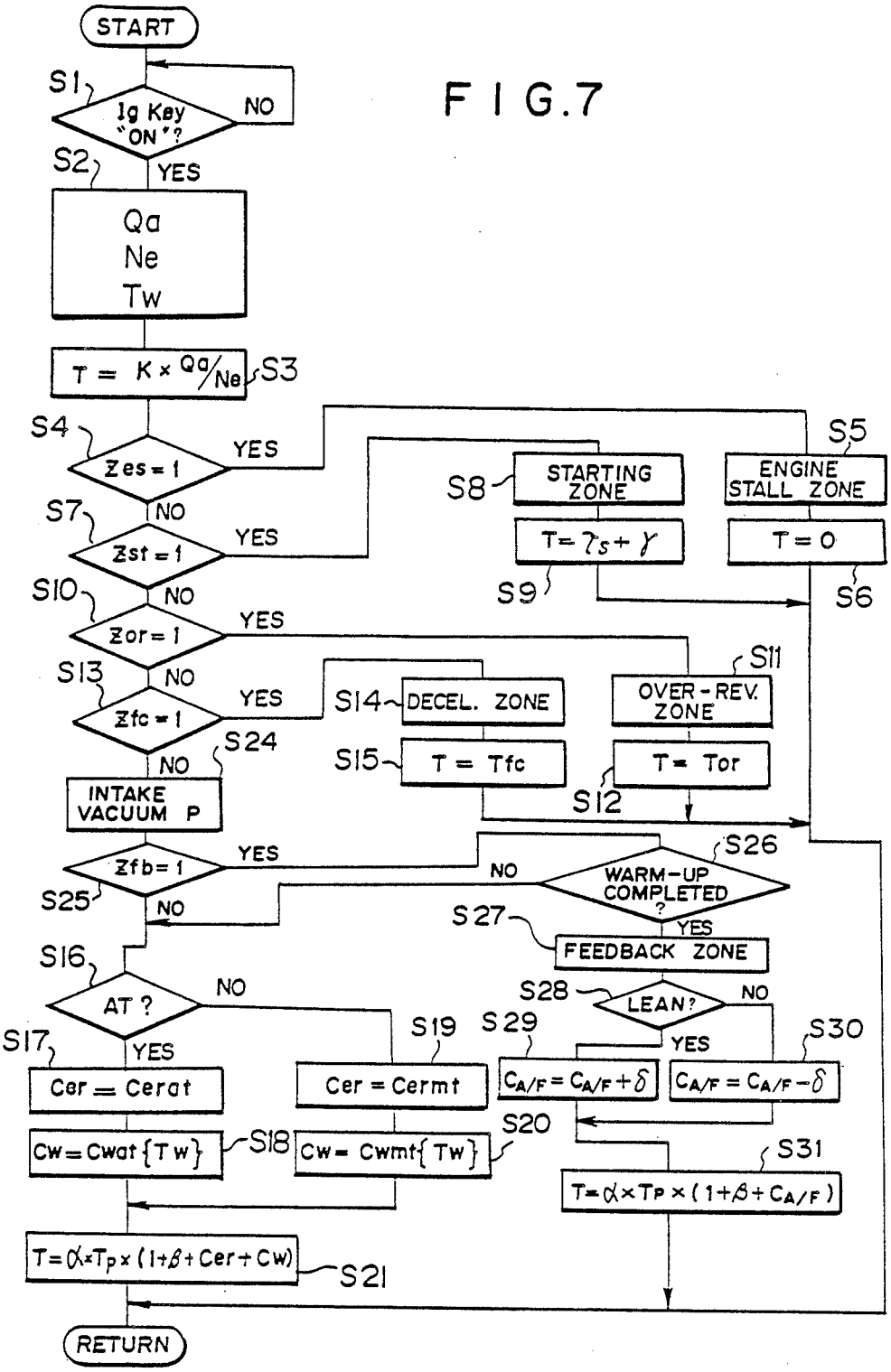
FIG. 7 is a flow chart for illustrating the operation of a control unit employed in the system shown in FIG. 6.

FIG. 6 shows a fuel supply control system in accordance with still another embodiment of the present invention. The system of this embodiment differs mechanically from the system shown in FIG. 1 in that an air-fuel ratio sensor 31 is provided in an exhaust passage 32 and a boost sensor 33 is provided in the intake passage 15 to detect the pressure in the intake passage 15 downstream of the throttle valve 18. The air-fuel ratio sensor 31 detects whether the actual air-fuel ratio is leaner than a preset value by detecting the oxygen concentration in the exhaust gas. In this embodiment, the operation of the control unit 24 is somewhat different from that shown in FIG. 2. The difference therebetween will be described with reference to the flow chart shown in FIG. 7. In the flow chart shown in FIG. 7, when it is determined that the operating condition is not in the deceleration zone in the step S13, the control unit 24 detects the intake vacuum P by way of the boost sensor 33 in step S24, and determines in step S25 whether the operating condition of the engine is in an air-fuel ratio feedback zone by way of an air-fuel ratio feedback zone flag Zfb which is set according to the engine speed Ne and the intake vacuum P. When it is determined that the operating condition of the engine is in the feedback zone in the step S25, it is determined in step S26 whether warm-up of the engine has been completed, that is, whether the coolant temperature Tw is higher than a preset value. When it is determined that the warm-up of the engine has been completed in the step S26, the control unit 24 determines whether the output of the air-fuel ratio sensor 31 indicates that the actual air-fuel ratio is leaner than a preset value. (Steps S27 and S28) When it is determined that the actual air-fuel ratio is leaner than the preset value, the control unit 24 increases an air-fuel ratio correction coefficient $C_{A/F}$ by a preset correction amount δ which is very small in step S29. Otherwise, the control unit 24 reduces the air-fuel ratio correction coefficient $C_{A/F}$ by the preset correction amount δ in step S30. Then in step S31, a final fuel injection pulse T is calculated.

When it is determined that the operating condition of the engine is not in the feedback zone in the step S25, or when is determined that the warm-up of the engine has not been completed in the step S26, the control unit 24 proceeds to step S16. Steps S1 to S15 and steps S16 to S21 in this flow chart are the same as those in the flow chart shown in FIG. 2.

Figure 8:
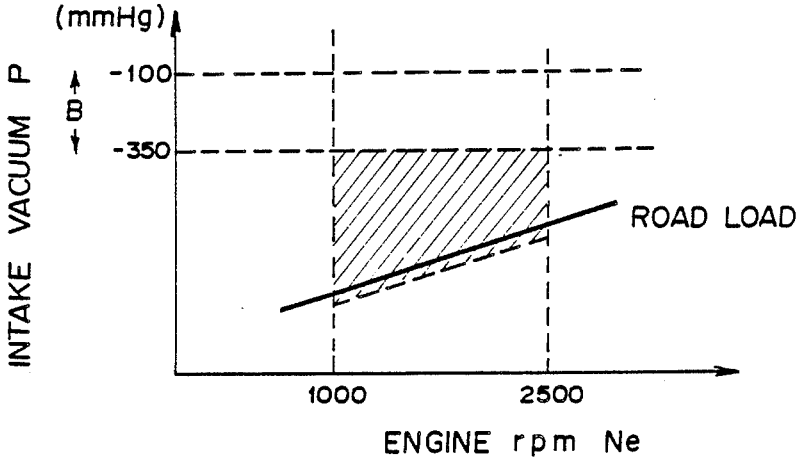
FIG. 8 is a view for illustrating an air-fuel ratio feedback zone.
Figure 9:
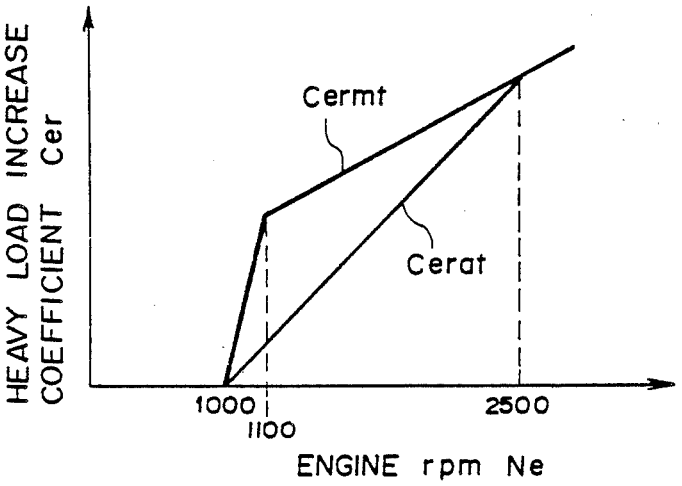
FIG. 9 is a view for illustrating the characteristics according to which the heavy load increase coefficient is set in the embodiment shown in FIG. 6.

The air-fuel ratio feedback zone flag Zfb is set at 1 when the operating condition of the engine is in the range shown by the hatched portion in FIG. 8, and otherwise is set at 0. In the range wherein the engine speed Ne is in the same range as the hatched portion and the intake vacuum P is in the range shown by B, a heavy load increase is effected. The heavy load increase coefficient Cer in this range is set according to the characteristics shown in FIG. 9. That is, the heavy load increase coefficient Cer is increased with increase in the engine speed Ne, and for a given engine speed Ne, the preset value Cerat for automatic transmission is smaller than the preset value Cermt for manual transmission.

Further, the preset values Cerat and Cermt are set so that the difference therebetween is increased as the engine speed Ne decreases. At the high engine speed ranges, the preset values Cerat and Cermt are of the same values.

We claim:

1. A fuel supply control system for an engine associated with a transmission for transmitting the engine output power to driving wheels of a vehicle, comprising a fuel supply means for supplying an amount of fuel according to engine operating condition, a fuel increasing means which increases the amount of fuel to be supplied to the engine when the engine is in a particular operating condition of at least one of heavy load, acceleration, and cold state, a transmission detecting means which detects whether the transmission associated with the engine is a manual transmission in which the engine output shaft and the transmission output shaft are mechanically connected or an automatic transmission in which the engine output shaft and the transmission output shaft are connected to permit slip therebetween, wherein said transmission detecting means sends a signal indicative of the transmission type and a fuel increase control means which controls the fuel increasing means according to whether the engine is associated with a manual transmission or an automatic transmission by receiving the signal from said transmission detecting means, so that the amount by which the fuel to be supplied to the engine is increased when the engine is in the particular operating condition is smaller when said transmission detecting means indicates that the engine is associated with an automatic transmission than when the transmission detecting means indicates that the engine is associated with a manual transmission so that operating performance is enhanced while improving fuel costs.

2. A fuel supply control system as defined in claim 1 in which said fuel increasing means increases the amount of fuel to be supplied to the engine when the engine operating condition is in a heavy load operation range.

3. A fuel supply control system as defined in claim 2 in which a difference between the fuel increasing amount when the engine is associated with a manual transmission and that when the engine is associated with an automatic transmission for a given engine speed becomes larger as the engine speed becomes lower.

4. A fuel supply control system as defined in claim 2 in which when the engine is operated at high speed under a heavy load, the fuel increasing amount when the engine is associated with the manual transmission is equal to that when the engine is associated with an automatic transmission.

5. A fuel supply control system as defined in claim 2 in which said heavy load operation range is on a heavier load side of an air-fuel ratio feedback control range in which the air-fuel ratio is feedback-controlled, and in the heavy load operation range, the air-fuel ratio is open-controlled.

6. A fuel supply control system as defined in claim 2 in which the amount by which the amount of fuel to be supplied to the engine when the operating condition of the engine is in the heavy load operation range is increased as the engine speed increases whether the engine is associated with a manual transmission or an automatic transmission.

7. A fuel supply control system as defined in claim 1 in which said fuel increasing means increases the amount of fuel to be supplied to the engine when the operating condition of the engine is in the early stages of acceleration.

8. A fuel supply control system as defined in claim 1 in which said fuel increasing means increases the amount of fuel to be supplied to the engine when the engine is being warmed up.

9. A fuel supply control system as defined in claim 8 in which the difference between the fuel increasing amount when the engine is associated with a manual transmission and that when the engine is associated with an automatic transmission becomes larger as the engine temperature becomes lower.

10. A fuel supply control system as defined in claim 1 in which said fuel increase control means increases the amount of fuel to be supplied to the engine so that the amount by which the fuel to be supplied to the engine is increased when the engine is in the particular operating condition is smaller when the engine is associated with an automatic transmission than when the engine is associated with a manual transmission by making the ratio of the fuel increasing amount to the basic amount of fuel to be supplied to the engine larger when the engine is associated with a manual transmission than when the engine is associated with an automatic transmission.

11. A fuel supply control system for an engine associated with a transmission for transmitting the engine output power to driving wheels of a vehicle comprising a fuel injection means for injecting an amount of fuel according to engine operating condition, a fuel increasing means which increases the amount of fuel to be supplied to the engine when the engine is in a particular operating condition of at least one of heavy load, acceleration, and cold state a transmission detecting means which detects whether the transmission associated with the engine is a manual transmission in which the engine output shaft and the transmission output shaft are mechanically connected or an automatic transmission in which the engine output shaft and the transmission output shaft are connected to permit slip therebetween, wherein said transmission detecting means sends a signal indicative of the transmission type, and a fuel increase control means which controls the fuel increasing means according to whether the engine is associated with a manual transmission or an automatic transmission by receiving the signal from said transmission detecting means, so that the ratio of the amount by which the fuel to be supplied to the engine is increased when the engine is in the particular operating condition to the basic amount of fuel to be supplied to the engine is smaller when said transmission detecting means indicates that the engine is associated with an automatic transmission than when the transmission detecting means indicates that the engine is associated with a manual transmission so that operating performance is enhanced while improving fuel costs.

12. A fuel supply control system as defined in claim 11 in which said fuel increasing means increases the amount of fuel to be supplied to the engine when the engine is being warmed up in a heavy load operation range, and the fuel increasing amount is set on the basis of the sum of a warm-up fuel increasing rate and a heavy-load fuel increasing rate, the warm-up fuel increasing rate being the ratio of the amount by which the amount of fuel to be supplied to the engine is increased when the engine is being warmed up to a basic amount of fuel to be supplied to the engine, and the heavy load fuel increasing rate being the ratio of the amount by which the amount of fuel to be supplied to the engine is increased when the operating condition of the engine is in the heavy load operation range to the basic amount of fuel to be supplied to the engine.

* * * * *